United States Patent [19]

Schötz

[11] Patent Number: 4,700,649

[45] Date of Patent: Oct. 20, 1987

[54] APPARATUS FOR CHANGING THE MAST OF A SAILBOARD

[76] Inventor: Udo Schötz, Rückersteg 4, D-5418 Selters, Fed. Rep. of Germany

[21] Appl. No.: 935,640

[22] Filed: Nov. 26, 1986

Related U.S. Application Data

[63] Continuation of Ser. No. 741,293, Jun. 4, 1985, abandoned.

[30] Foreign Application Priority Data

Jun. 13, 1984 [DE] Fed. Rep. of Germany ..... 3421883

[51] Int. Cl.[4] ..... B63B 15/00

[52] U.S. Cl. ..... 114/90; 114/74 R; 114/39

[58] Field of Search ..... 114/89-91, 114/39.2; 441/74, 75

[56] References Cited

U.S. PATENT DOCUMENTS

| | | | |
|---|---|---|---|
| 3,507,240 | 4/1970 | Butler | 114/90 |
| 4,273,062 | 6/1981 | Marker | 114/91 |
| 4,449,466 | 5/1984 | Marker | 114/39.2 |
| 4,455,959 | 6/1984 | Suzuki | 114/90 |
| 4,508,046 | 4/1985 | Coulter | 441/74 |
| 4,530,299 | 7/1985 | Ross | 441/74 |

FOREIGN PATENT DOCUMENTS

| | | | |
|---|---|---|---|
| 3233417 | 3/1984 | Fed. Rep. of Germany | 114/91 |
| 3335000 | 4/1985 | Fed. Rep. of Germany | 114/91 |

*Primary Examiner*—Joseph F. Peters, Jr.
*Assistant Examiner*—C. T. Bartz
*Attorney, Agent, or Firm*—Young & Thompson

[57] ABSTRACT

The device for adjusting the mast of a sailboardcomprises a slide (4) accommodating the mast foot via a rubber joint (7) and a safety coupling, this slide being guided adjustably and lockably on a profiled rail (1) countersunk in the sailboard (3) in the longitudinal extension of the latter, wherein, for the formation of a point readily bendable in one plane, the rubber joint (7) between the mast and the slide (4) consists of an upper section (8) and a lower section (9), which sections are connected with each other to be pivotable about a hinge pin (10) arranged perpendicularly to the mast.

1 Claim, 3 Drawing Figures

APPARATUS FOR CHANGING THE MAST OF A SAILBOARD

This application is a continuation of application Ser. No. 741,293, filed 6/4/85, now abandoned.

The invention relates to a device for adjusting the mast of a sailboard.

Adjustment of the mast mounting point in the longitudinal extension of the sailboard is conventional and is performed by advanced boardsailors for obtaining optimum sailing properties. In the construction of the adjusting device, a structural height which is as low as possible must be the desired objective, in order to arrange the bending point of the mast, i.e. the rubber joint at the foot of the latter, as low as possible above the surface of the sailboard. However, this means that the pivot to be inserted in the slide of the adjusting device is very short in this case so that, once the mast has detached itself from the safety coupling, during a boardsailor's fall into the water, and likewise lies in the water, it is extraordinarily difficult to reinsert the mast foot by hand in the opening of the slide by bending the rubber joint, inasmuch as the pivot below the rubber joint offers only a short lever arm, which would require too great a force to be expended.

The invention is based on the object of substantially facilitating reinsertion of the mast foot, with the mast lying prone, in case of an especially shallow (low) structural height of the mast adjusting device.

On account of the separate hinge joint within the rubber joint, it is relatively simple, even with very short mast foot pivots, to bend the rubber joint in the water about the hinge pin by 90° and more in order to reinsert the mast in te mounting aperture of the safety coupling; practically no force needs to be expended during this step. In this way, a very low construction height of the mast adjusting device is likewise possible, attained, last but not least, also by the horizontally disposed detent bar.

One embodiment of the mast adjusting device according to this invention is illustrated in the drawings wherein.

Figure 1:
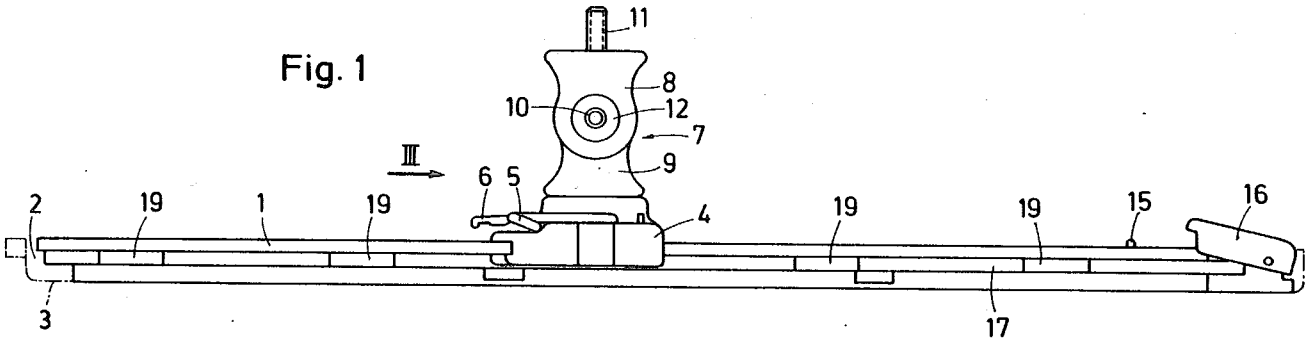
FIG. 1 is a lateral view of the mast adjusting device.

The mast adjusting device comprises chiefly a profiled rail 1 mounted in a trough-like, but relatively shallow indentation 2 of a sailboard 3, indicated in dot-dash lines, as well as a slide 4 displaceably guided on the profiled rail 1 in the longitudinal direction of the sailboard 3, the slide housing a conventional safety coupling, not illustrated in detail in the drawing, with a spring clip 5 and an operating shackle 6. A pivot of the mast foot, which pivot is not visible, is arranged in the safety coupling; this pivot is freely rotatably connected with a rubber joint 7 and retained with a predetermined force by the spring clip 5.

The rubber joint 7 consists of an upper section 8 and a lower section 9, these sections being swingably connected with each other by way of a hinge pin 10, the axis of the latter extending perpendicularly to the mast, not shown. The mast is connected to the upper section 8 of the rubber joint 7 by way of a threaded bolt 11. The hinge pin 10 can be a hollow metal pin flanged back at the ends onto shims 12.

With the rig lying in the water, the mast can be readily reinserted with its foot in the mounting of the slide 4 by bending the rubber joint 7 about the hinge pin 10 by a suitable angle which can amount to more than 90°. The rubber joint 7 is freely bendable only in the pivoting direction about the hinge pin 10 whereas it acts in all other directions like a conventional rubber joint.

Figure 2:
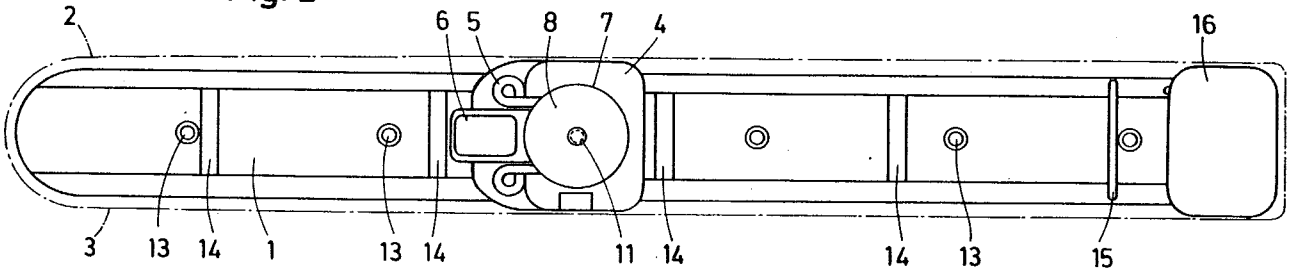
FIG. 2 is a top view thereof.
Figure 3:
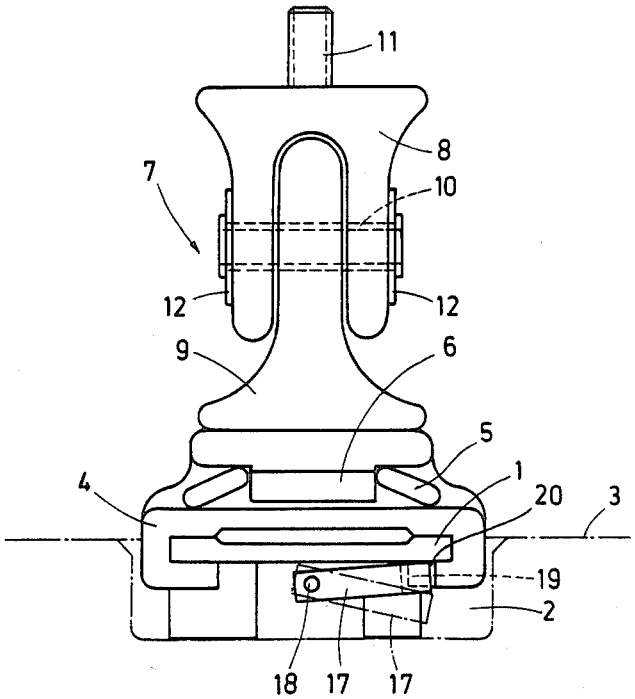
FIG. 3 is a view in the direction of arrow III in FIG. 1.

The profiled rail 1 exhibits mounting bores 13 (FIG. 2) for fastening screws (not shown), by means of which the rail is fastened in the indentation 2 at the sailboard 3. Furthermore, markings 14 are provided on the profiled rail 1, denoting the respective locking positions of the slide 4. In the illustrations of FIGS. 1 and 2, the left-hand side is the bow side, and the right-hand side is the stern side.

On the stern side, a stop 15 for the slide 4 is arranged on the profiled rail 1, this stop being located in front of a foot-operated key 16 that can be used to release a detent bar 17 in order to shift the slide 4 and thus to vary the position of the mast with respect to the sailboard 3 in the longitudinal extension of the same. The detent bar 17 is mounted to be pivotable up and down about an axle 18 disposed in the longitudinal direction with respect to the sailboard 3 and with respect to the profiled rail 1, and is pretensioned into the locking position by means of a spring, not shown. The detent bar has cutouts 19 accommodating, in each detent position of the slide 4, a corresponding projection 20 provided at the slide. The arrangement can also be such that projections provided at the detent bar 17 lock into a corresponding recess of the slide 4.

I claim:

1. Device for adjusting the mast of a sailboard, with a slide accommodating the mast foot by way of a rubber joint, this slide being guided so that it can be adjusted and locked in position on a profiled rail countersunk in the sailboard in the longitudinal extension of the latter, characterized in that the rubber joint (7) between the mast and the slide (4) consists of an upper rubber section (8) and a lower rubber section (9), which rubber sections are pivotably connected with each other about a hinge pin (10) arranged perpendicularly to the mast and passing through the rubber joint, the hinge pin (10) being hollow and being flanged back on its ends onto shims (12) which are disposed against the rubber joint.

* * * * *

UNITED STATES PATENT AND TRADEMARK OFFICE

CERTIFICATE OF CORRECTION

PATENT NO. : 4,700,649

DATED : October 20, 1987

INVENTOR(S) : Udo Schutz

It is certified that error appears in the above-identified patent and that said Letters Patent is hereby corrected as shown below:

On the title page of the patent, Item Nos. 19 and 76 correct the surname of the inventor, from "Schotz" to -- Schutz --,

Signed and Sealed this

Sixteenth Day of February, 1988

*Attest:*

DONALD J. QUIGG

*Attesting Officer*

*Commissioner of Patents and Trademarks*